US005482023A

United States Patent [19]

Hunt et al.

[11] Patent Number: 5,482,023

[45] Date of Patent: Jan. 9, 1996

[54] COLD START FUEL CONTROL SYSTEM

[75] Inventors: Frank W. Hunt, White Lake; Toshiharu Nogi, Novi, both of Mich.

[73] Assignee: Hitachi America, Ltd., Research and Development Division, Tarrytown, N.Y.

[21] Appl. No.: 364,893

[22] Filed: Dec. 27, 1994

[51] Int. Cl.[6] ..... F02D 41/06; F02M 33/02; F02M 51/00

[52] U.S. Cl. ..... 123/491; 123/520

[58] Field of Search ..... 123/491, 520, 123/518, 519, 516, 198 D

[56] References Cited

U.S. PATENT DOCUMENTS 5,224,456 7/1993 Hosoda et al. ..... 123/491

5,394,857 3/1995 Yamakawa ..... 123/491

*Primary Examiner*—Raymond A. Nelli

*Attorney, Agent, or Firm*—Gifford, Krass, Groh, Sprinkle, Patmore, Anderson & Citkowski

[57] ABSTRACT

A cold start fuel control system as provided for an internal combustion engine of the type having at least one combustion chamber, an intake manifold and a source of fuel. A fuel vapor canister has an interior chamber fluidly connected to the source of fuel and a normally closed shut-off valve fluidly connected between the canister and ambient air. A normally closed purge valve is then fluidly connected in series between the interior of the canister and the intake manifold. The system also includes a cold start fuel injector having an inlet connected to the fuel source and an outlet open to the intake manifold or, optionally, to the interior of the fuel vapor canister. During a cold start engine condition, fuel is supplied as needed from both the fuel vapor canister and cold start injector by activating the cold start injector and simultaneously opening the purge and shut-off valves in synchronism with the engine intake cycle(s). An air flow sensor measures the mass flow of the air/fuel mixture to the engine and provide an output signal to an electronic control unit which controls the activation of the cold start fuel injector and/or valves to achieve a stoichiometric or slightly lean air/fuel mixture. Additionally, secondary air is provided through the cold start fuel injector for enhancing the atomization of the fuel in the air from the cold start injector.

32 Claims, 8 Drawing Sheets

COLD START FUEL CONTROL SYSTEM

BACKGROUND OF THE INVENTION

1. Field of the Invention

The present invention relates generally to fuel control systems for internal combustion engines and, more particularly, to a cold start fuel control system.

2. Description of the Prior Art

Most modem day internal combustion engines of the type used in automotive vehicles include a plurality of internal combustion chambers. An intake manifold has one end open to ambient air and its other end open to the internal combustion chambers via the engine intake valves. During a warm engine condition, a multi-point fuel injector is associated with each of the internal combustion chambers and provides fuel to the internal combustion chambers. The activation of each multi-point fuel injector is controlled by an electronic control unit (ECU).

During a cold start engine condition, however, a single cold start fuel injector is often times provided in the air intake manifold to the engine. The single cold start fuel injector injects sufficient fuel into the air intake passageway to provide fuel for all of the cylinders of the engine during engine warmup. As the engine warms up, the cold start fuel injector is gradually deactivated while, simultaneously, the multi-point fuel injectors are gradually activated in order to provide a smooth transition between the cold start fuel injector and the multi-point injectors.

In order to ensure engine start up during a cold engine condition, it has also been the previous practice for the cold start fuel injector to inject sufficient fuel into the engine in order to achieve a rich air/fuel mixture having a ratio in the range of 10:1 to 14:1. Even though such a rich air/fuel ratio is sufficient to ensure proper starting of the engine during a cold starting condition, the overly rich air/fuel ratio produces a relatively high amount of undesirable engine emissions such as hydrocarbon and nitrous oxide emissions.

Such an overly rich air/fuel mixture has been required to ensure that there is sufficient fuel vapor within the internal combustion engine in order to ensure engine starting. Such vaporization of fuel is more difficult to attain during a cold start condition than a warm engine condition since the fuel is not vaporized by contacting hot portions, e.g. the internal combustion chamber, of the engine.

While such previously known cold start engine systems have been sufficient to ensure proper starting of the engine while meeting prior governmental regulations, such systems are inadequate to meet the proposed future governmental regulations relating to exhaust emissions from automotive vehicles. For example, the United States emission regulations for CO, HC/NMOG and $NO_x$ for the year 1991 are 7.0, 0.39 and 0.40 grams/mile respectively. For the model year 1997, the corresponding levels must be reduced to 1.7, 0.040 and 0.20 grams/mile, respectively.

SUMMARY OF THE PRESENT INVENTION

The present invention provides a cold start engine fuel control system which overcomes all of the above-mentioned disadvantages of the previously known systems.

In brief, the cold start fuel control system of the present invention includes a fuel vapor canister having an interior chamber filled with fuel absorbent material. This internal chamber of the canister is fluidly connected to the fuel tank. Additionally, a normally closed shut-off valve is fluidly connected between the canister and ambient air while a normally closed purge valve is fluidly connected in between the interior of the canister and the intake manifold.

In addition, the system of the present invention includes a cold start fuel injector having its inlet connected to the fuel source, i.e. the fuel pump outlet, and its outlet connected to the intake manifold. In one embodiment, the outlet from the cold start fuel injector is connected directly to the intake manifold so that fuel injections from the cold start injector are introduced directly into the intake manifold.

In a second preferred embodiment, the cold start fuel injector is secured to the fuel vapor canister so that the fuel from the cold start fuel injector are introduced directly into the interior of the fuel vapor canister. The fuel vapor canister is also preferably heated to increase the vaporization of fuel within the fuel vapor canister.

An electronic control unit (ECU) controls the operation of the shut-off valve, purge valve and cold start fuel injector. This ECU receives input signals from mass gas flow sensors fluidly connected in series with both the intake manifold as well as the fluid passageway between the fuel vapor canister and the intake manifold.

In operation, the ECU selectively operates both the shut-off and purge valves as well as the cold start fuel injector in synchronism with the intake stroke(s) for the combustion chamber(s) in order to obtain a stoichiometric or slightly lean air/fuel mixture to the engine. Such a stoichiometric or slightly lean air/fuel mixture effectively reduces the creation of undesirable engine emissions from the engine. Furthermore, since the fuel provided by the fuel vapor canister is already vaporized, fuel vapors are provided to the engine to ensure starting of the engine during a cold engine condition without the necessity of using an overly rich air/fuel mixture.

Additionally, in order to enhance the vaporization of the fuel injector from the cold start injector, preferably secondary air is provided through the cold start fuel injector so that the air intermixes with the fuel injection and further vaporizes or atomizes the fuel injection from the cold start injector. This secondary air can be colinear and/or transverse to the direction of the fuel injection pulse from the injector.

Still other means are optionally provided to enhance the vaporization of the fuel injection from the cold start injector. In one embodiment of the invention, the fuel injection passes through a honeycomb heater which vaporizes the fuel. Still other means are used to increase the mechanical turbulence between the air and the fuel and thus the degree of vaporization of the fuel within the air from the fuel injection from the cold start injector.

BRIEF DESCRIPTION OF THE DRAWING

A better understanding of the present invention will be had upon reference to the following detailed description, when read in conjunction with the accompanied drawing, wherein like reference characters refer to like parts throughout the several views, and in which.

Figure 10:
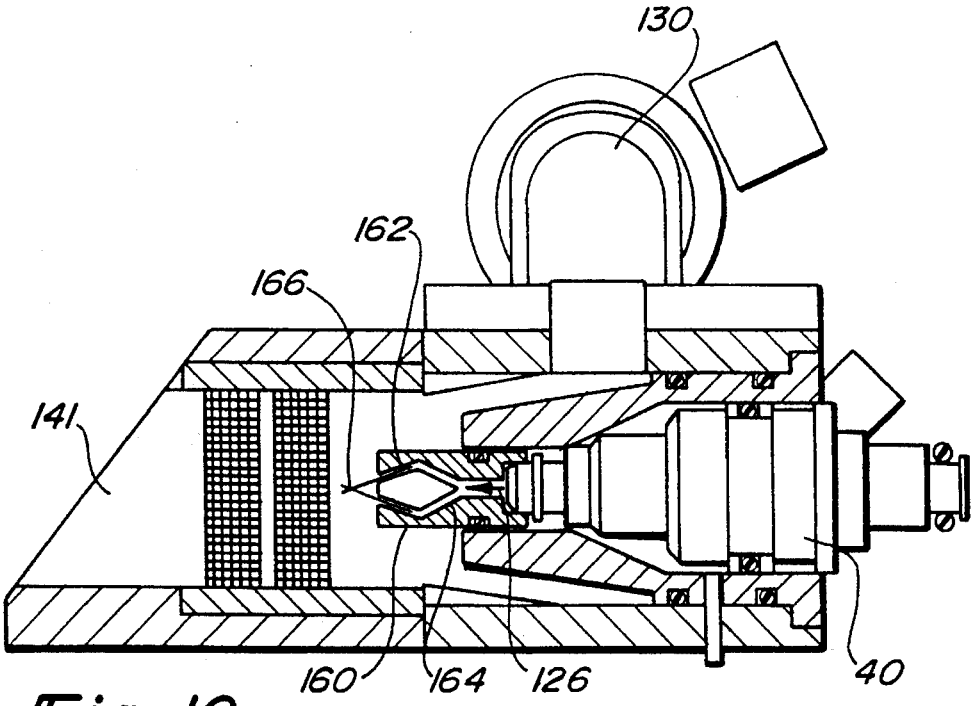
Figure 12:
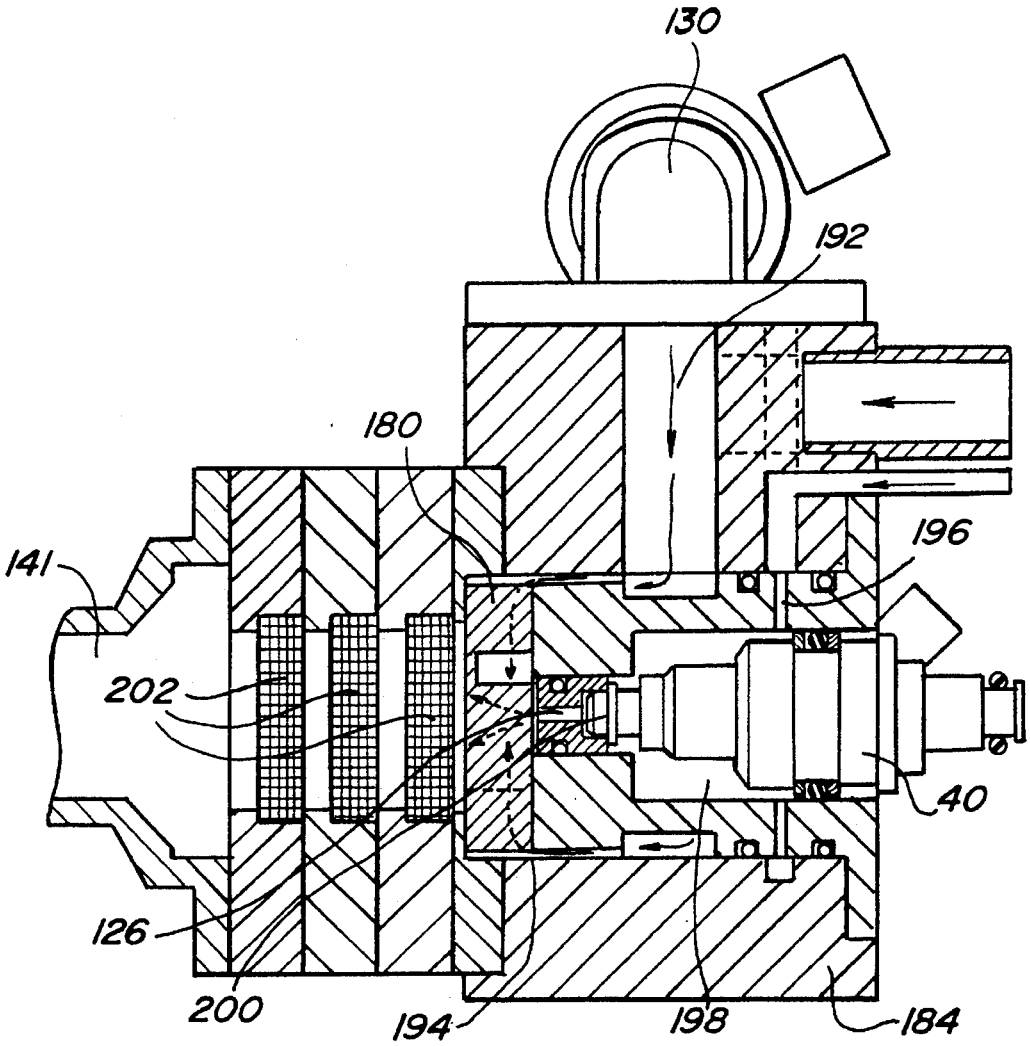
Figure 13:
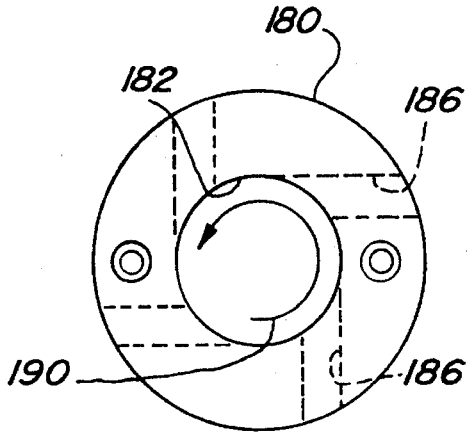
Figure 14:
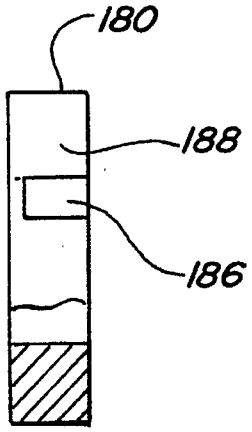

FIGS. *9a–9d* are further preferred embodiments of the heater for the cold start fuel injector;

FIG. 10 is a further longitudinal sectional view illustrating a preferred embodiment of the cold start fuel injector;

FIGS. *11a–11d* illustrate modifications of the cold start fuel injector illustrated in FIG. 10;

FIG. 12 is a view similar to FIG. 10 but illustrating a further preferred embodiment of the invention;

FIG. 13 is a view taken along line 13—13 in FIG. 12 and with parts removed for clarity; and FIG. 14 is a partial fragmentary fight side view of FIG. 13.

DETAILED DESCRIPTION OF PREFERRED EMBODIMENTS OF THE PRESENT INVENTION

Figure 1:
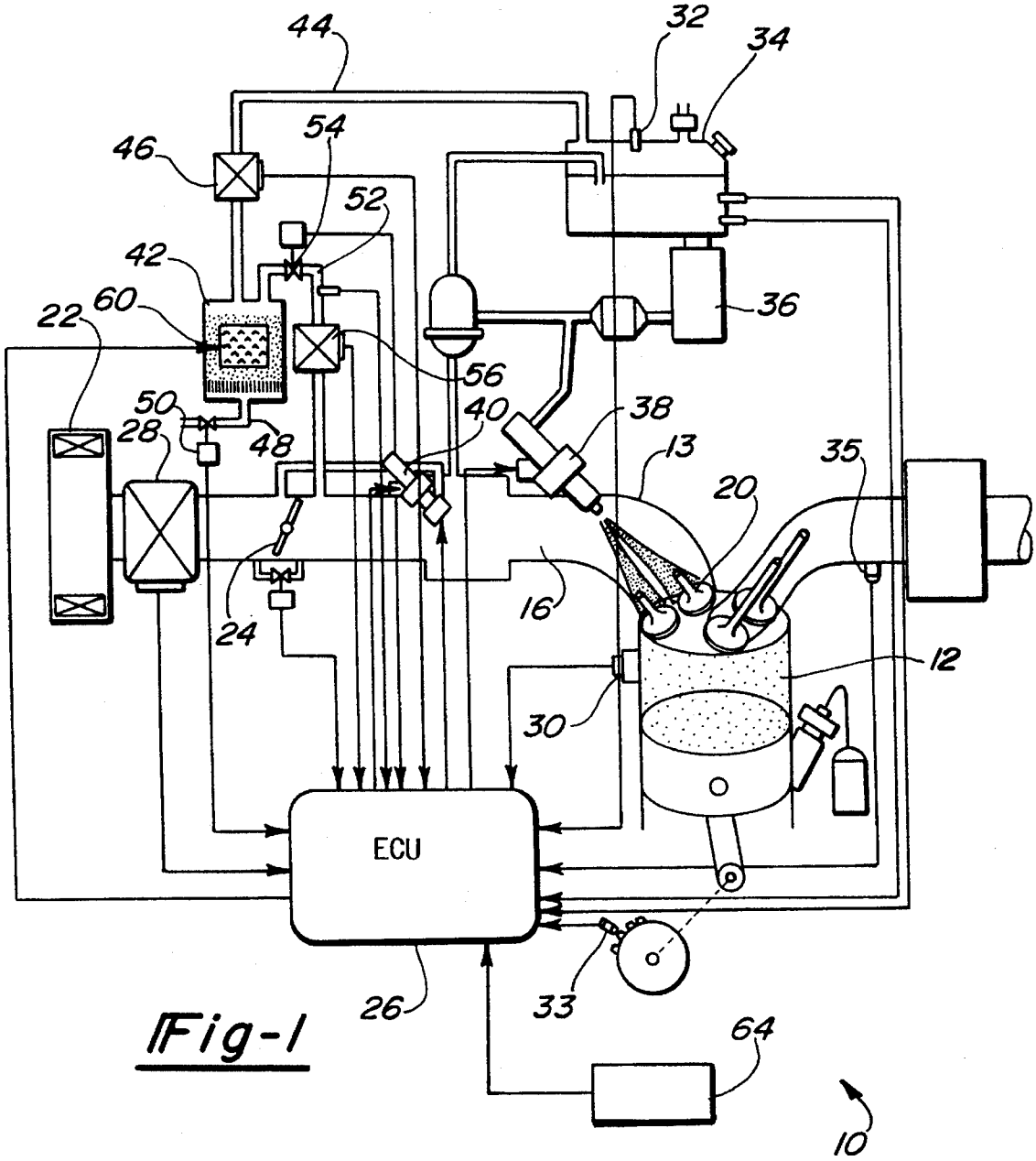
FIG. 1 is a diagrammatic view illustrating a preferred embodiment of the present invention.

With reference first to FIG. 1, a preferred embodiment of the cold start fuel control system of the present invention is thereshown for use with an internal combustion engine 10 having at least one internal combustion chamber 12. The internal combustion engine 10 is typically of the type used in automotive vehicles and, for that reason, typically includes a plurality of combustion chambers 12 even though only one is illustrated in FIG. 1.

An intake manifold 13 forms an air intake passageway 16 between ambient air at 18 and the internal combustion chambers 12 via valves 20. An air filter 22 at the intake filters the air inducted into the engine 10 in the conventional fashion while a throttle 24 controls the air flow through the intake manifold 14 to the engine combustion chamber 12.

An electronic control unit (ECU) 26 controls the operation of the control system of the present invention. Typically, the ECU 26 is microprocessor based and receives a plurality of input signals from various engine sensors. These input signals include a signal from a mass gas flow sensor 28 indicative of the mass gas flow through the intake manifold 13, the coolant temperature from a coolant temperature sensor 30, fuel tank vapor temperature from a fuel tank vapor temperature sensor 32, an ignition key sensor 64, speed sensor 33, Lambda sensor 35 as well as other conventional engine sensors.

The internal combustion engine 10 further includes a source of fuel or gas tank 34 which provides fuel to the internal combustion engine in a fashion to be subsequently described in greater detail. A fuel pump 36 provides pressurized fuel to a multipoint fuel injector 38, one of which is associated with each combustion chamber 12, as well as a cold start fuel injector 40 which will be subsequently described in greater detail.

The fuel delivery system for the engine 10 also includes a fuel vapor canister 42 which is fluidly connected to the top of the fuel tank 34 by a fluid line 44. Optionally, a mass gas flow sensor 46 is provided in series with the line 44 and provides an output signal to the ECU representative of the mass gas flow from the fuel tank 34 and to the fuel vapor canister 42.

The fuel vapor canister 42 typically is filled with a fuel vapor absorbent material, such as activated charcoal, which absorbs fuel vapors from the fuel tank 34. An air inlet line 48 has one end 50 open to ambient air and its other end open to the bottom of the fuel vapor canister 42. A normally closed shut-off valve is connected in series with the line 48 and is activated, or opened, by the appropriate command from the ECU 26.

A purge line 52 from the fuel canister 42 fluidly connects the top of the fuel canister 42 to the air passageway 16 of the intake manifold 13. A normally closed purge valve 54 is connected in series with the line 52 so that, when opened by the appropriate command from the ECU 26, fuel vapors from the canister 42 are inducted through the line 42 and into the intake manifold 13. A mass gas flow sensor 56 generates an output signal representative of the mass gas flow through the line 52 and this output signal is connected as an input signal to the ECU 26.

Still referring to FIG. 1, preferably a heater 60 is provided within the fuel vapor canister 42. Upon activation of the heater 60 by command from the ECU 26, the heater is energized and ensures that the entrapped fuel vapors within the canister 42 are completely vaporized.

In operation, during a cold start engine condition as determined by the coolant temperature from sensor 30, the ECU generates output signals to activate the heater 60 as well as open the shut-off valve 50 and purge valve 54 in synchronism with the retake stroke(s) of the combustion chamber(s) 12. Thus, upon cranking, the pistons induct air through the air passageway 16 of the intake manifold 14 and, simultaneously, induct fuel vapors from the canister 42 through the fluid line 52 and through the air passageway 16. The mass gas flow through the line 52 is measured by the sensor 56 which provides this output signal representative thereof to the ECU 26.

Simultaneously, the ECU 26 activates the cold start fuel injector 40 in synchronism with the, intake cycles and deactivates the multipoint fuel injectors 38 so that the cold start fuel injector 40 provides fuel from its inlet, which is connected to the outlet from the pump 36, to its outlet which is directed into the air passageway 16. In this fashion, both the fuel entrained within the fuel vapor canister 42, as well as fuel from the cold start injector 40 are used to power the engine during a cold start engine operating condition. The actual program control for the operation of the valves 50 and 54, as well as the cold start injector 40 will be subsequently described.

Figure 2:
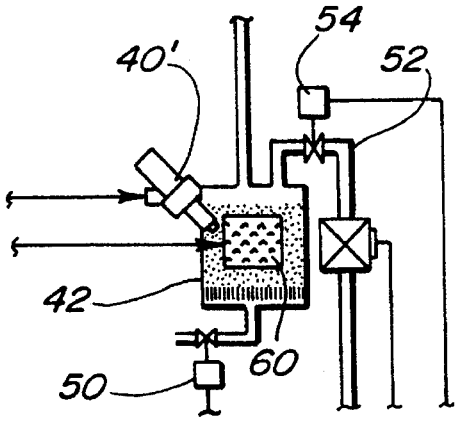
FIG. 2 is a diagrammatic view, similar to FIG. 1, illustrating a second preferred embodiment of the present invention.

With reference now to FIG. 2, a modification of the fuel control system is thereshown in which the cold start fuel injector 40' has its outlet connected to the interior of the fuel canister 42. Thus, upon each activation of the cold star fuel injector 40' by command from the ECU 26 (not shown), the cold start fuel injector 40 injects the fuel pulse into the interior of the fuel vapor canister 42. As before, a heater 60 is preferably contained within the fuel vapor canister 42 so that fuel not only within the fuel vapor canister 42, but also the fuel injected by the cold start injector 40' is vaporized by the heater 60.

In the FIG. 2 embodiment, the fuel vapor from the canister 42 is inducted through the passageway 52 by opening the purge valve 54 and shut-off valve 50 via commands from the ECU 26 so that the air/fuel mixture is inducted into the intake manifold 13. As before, a mass gas flow sensor 56 measures the mass gas flow through the line 52 and provides this as an input signal to the ECU 26.

Figure 3:
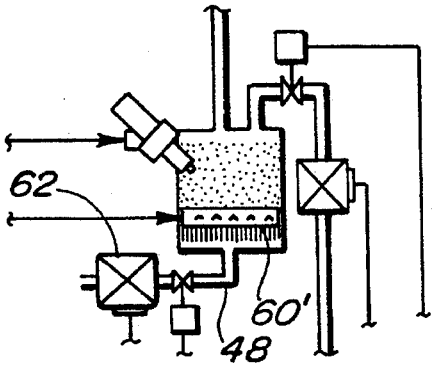
FIG. 3 is a fragmentary diagrammatic view illustrating a further preferred embodiment of the present invention.

With reference now to FIG. 3, a still further modification of the preferred embodiment of the present invention is thereshown. The FIG. 3 embodiment differs from the FIG. 2 embodiment in two respects. First, in the FIG. 3 embodiment, the heater 60' is positioned at the bottom of the fuel vapor canister 42 so that ambient air inducted through the shut-off line 48 first passes through the heater before contacting the fuel vapors within the interior of the canister 42. In doing so, the warm air inducted into the interior of the canister 42 further assists in the vaporization of the vapor within the canister 42 prior to induction of the air/fuel mixture to the engine.

Secondly, in the FIG. 3 embodiment, a mass gas flow sensor 62 is also provided in series with the shut-off passageway 48 to the canister 42. This mass gas flow sensor 62 provides an output signal to the ECU 26 which permits an accurate calculation, in conjunction with the mass gas flow sensor 56, of the amount of fuel inducted from the canister 42 to the intake air passageway 16 during a cold start engine operation.

Referring again to FIGS. 1 and 2, in certain cold starting engine conditions, such as an acceleration condition, the fuel injected by both the cold start injector 40 as well as fuel inducted from the canister 42 are inadequate to provide sufficient fuel to the engine. During such a condition, the ECU 26 also generates output signals to activate the multipoint fuel injectors 38 in order to supply additional fuel to the engine. The multipoint fuel injectors 38, furthermore, are activated synchronously with the intake cycle for the combustion chamber 12 associated with each multipoint injector 38. Furthermore, in such a situation, the engine power takes precedence over low emission control.

Figure 5:
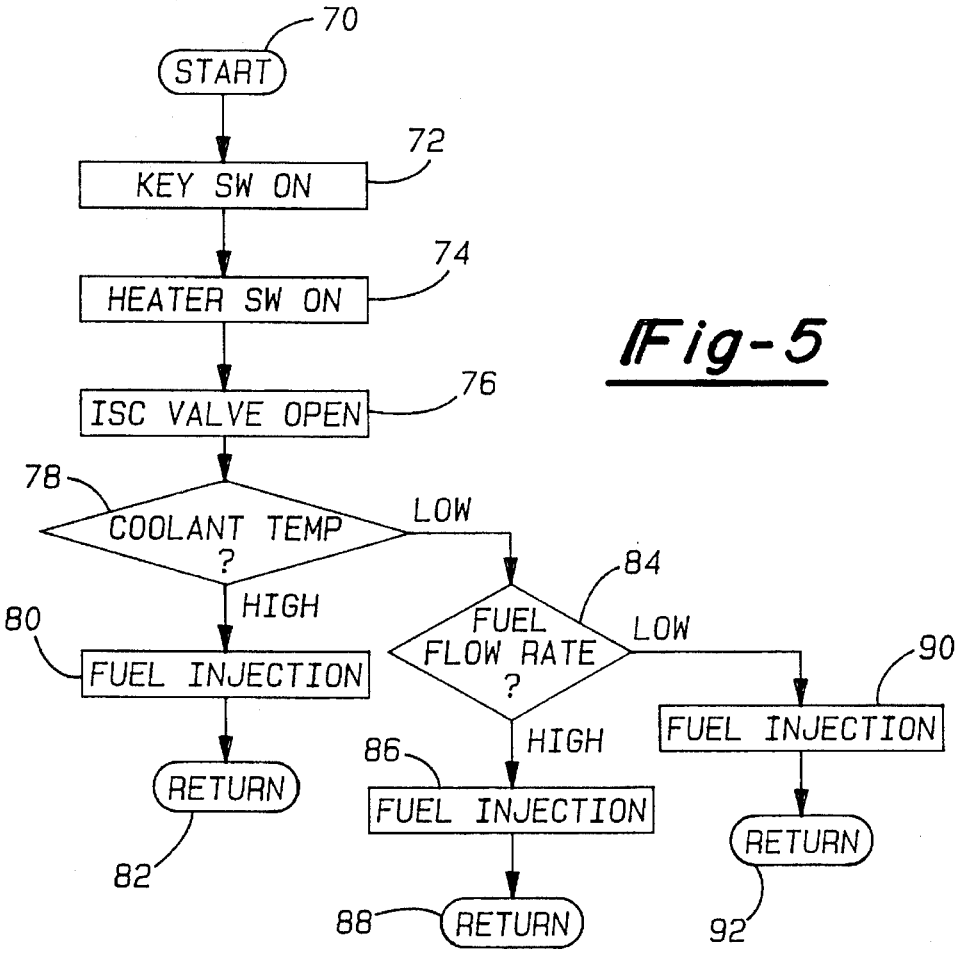
FIG. 5 is a flow chart illustrating the operation of the preferred embodiment of the present invention.

With reference now to FIG. 5, a flow chart depicted in the operation of the fuel control system of the present invention is thereshown. This program controls the operation of the ECU 26.

The program starts at step 70 and immediately branches to step 72 which detects the insertion of a key into the key sensor 64 (FIG. 1). When such a key insertion is detected, the program branches to step 74 where the ECU 26 activates the heater 60 (if present) in the fuel vapor canister 42.

Step 74 then branches to step 76 at which the ISC valve 130 is open to provide supplemental air to the cold start fuel injector 40 in a fashion which will be subsequently described in greater detail. Step 76 then branches to step 78 where the ECU 26 reads the temperature of the coolant from the coolant temperature sensor 30.

Assuming that the coolant temperature 30 is high, indicating a warm engine condition, step 78 branches to step 80 where the ECU 26 controls the activation of only the multipoint fuel injectors 38. These multipoint fuel injectors 38 are activated synchronously with the intake cycle for each combustion chamber 12 in the conventional fashion so that a further description thereof is unnecessary. Step 80 then branches to step 82 and returns.

Assuming that the coolant temperature is low, step 78 instead branches to step 84 which determines if the fuel demand is high or low. A high demand would result, for example, during an open throttle position while, conversely, a low fuel demand would result during a closed throttle or idle condition.

Assuming that a high fuel flow rate is demanded, step 84 branches to step 86 where the ECU 26 generates output signals to the shut-off valve 50 and purge valve 54 in synchronism with the intake cycles to provide fuel from the canister 42 to the intake manifold 13. Simultaneously, the ECU 26 generates output signals to the cold start fuel injector 40 to provide fuel to the intake manifold 13 as well as to the multipoint fuel injectors 38 to supply any further needed fuel to the engine. Step 86 then branches to step 88 and returns.

Assuming instead that only a low fuel demand is present, e.g. during an idle condition, step 84 instead branches to step 90. At step 90, the ECU 26 activates only the cold start fuel injector 40 and the valves 50 and 54 to provide fuel flow from the canister 42 to the intake manifold 13 in order to provide the necessary fuel to the engine. Step 90 then branches to step 92 and returns.

Figure 4:
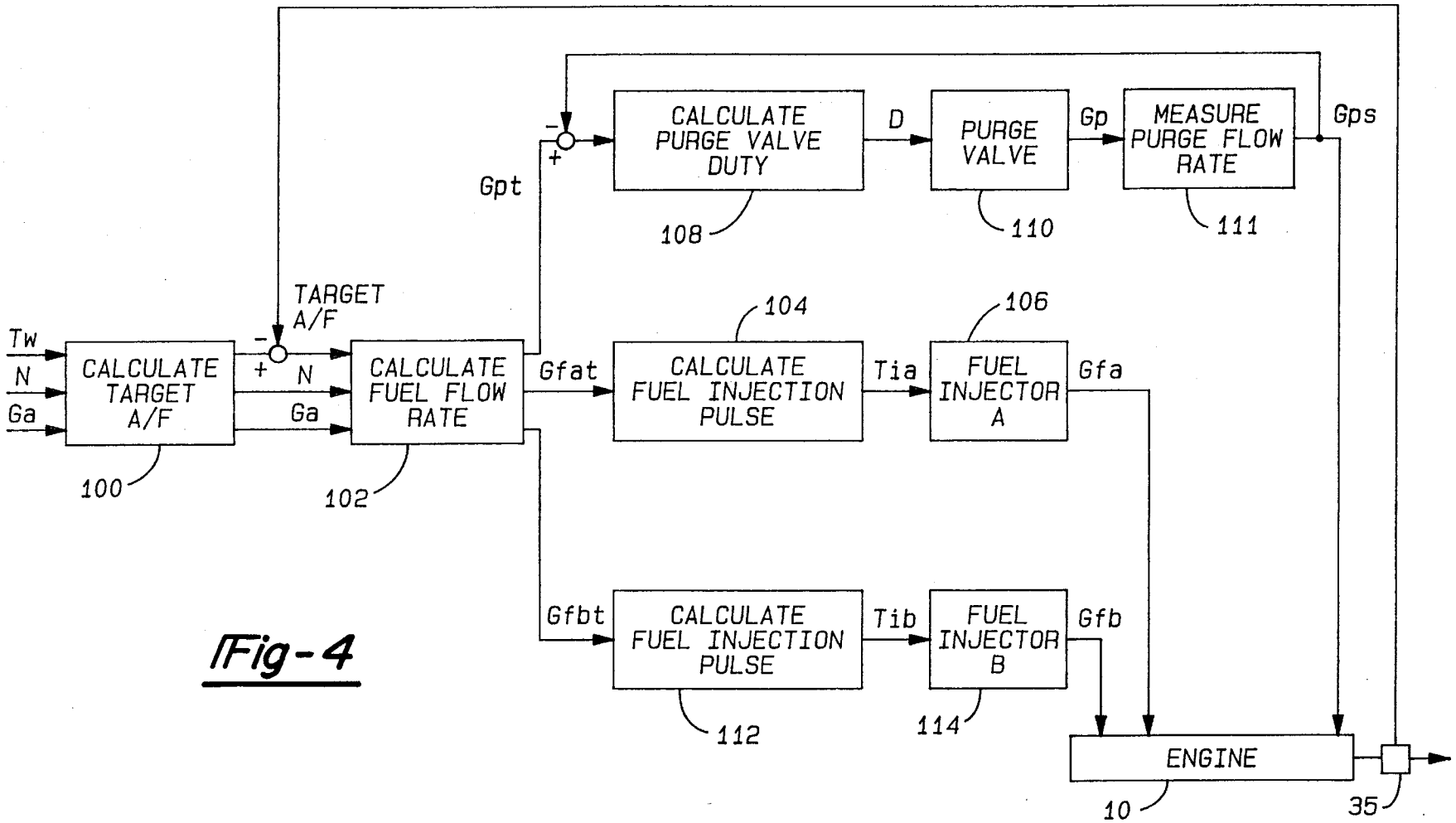
FIG. 4 is a block diagrammatic view illustrating the operation of the present invention.

With reference now to FIG. 4, ideally the air fuel mixture supplied to the engine during a cold start engine condition will be at stoichiometric or slightly lean. Consequently, fuel combustion efficiency is maximized and the generation of noxious emissions simultaneously minimized.

Referring now to FIG. 4, in order for the ECU 26 to generate the appropriate control signals to the cold start fuel injector 40, a purge valve 54 and shut-off valve 50 as well as the activation of the multipoint injectors 38, if necessary, the ECU 26 at step 100 receives the input signal Ga representative of the mass gas flow rate from the sensor 28, the engine speed N from the speed sensor 33 and the coolant temperature $T_w$ from the coolant temperature sensor 30. Step 100, utilizing these parameters, calculates the target air/fuel ratio.

After step 100 calculates the target air/fuel ratio, it branches to step 102 which calculates the necessary fuel flow rate to attain the target air/fuel ratio. Then, assuming only a low fuel demand is required (step 90 in FIG. 5), step 102 branches to step 104 which calculates the fuel injection pulse required from the cold start injector 40 and then provides its output signal to the cold start injector 40 at step 106. This fuel is then provided to the engine 10.

At the same time, the necessary duty cycle for the purge valve 54 is calculated at step 108 and the ECU 26 then provides the appropriate signal to the purge valve 54 at step 110. Step 111 then measures the mass gas flow rate from the canister 42 from the sensor 56 and provides a sensor feedback signal to step 108. This feedback signal is used to modify the purge valve duty cycle at step 108 to achieve the target air/fuel ratio.

Assuming a higher fuel flow demand, e.g. during an acceleration condition (step 86 in FIG. 5), step 112 also calculates the necessary fuel injection pulse for the multipoint injector 38 and activates the multipoint fuel injectors 38 at step 114 in synchronism with the intake cycle for each combustion chamber 12.

Still referring to FIG. 4, the output signal from the Lambda sensor 35 (FIG. 1) is also provided as a feedback signal representative of the air/fuel ratio in the exhaust to step 102. This feedback signal enables step 102 to compensate for differences between the target and actual air/fuel ratio.

Figure 6:
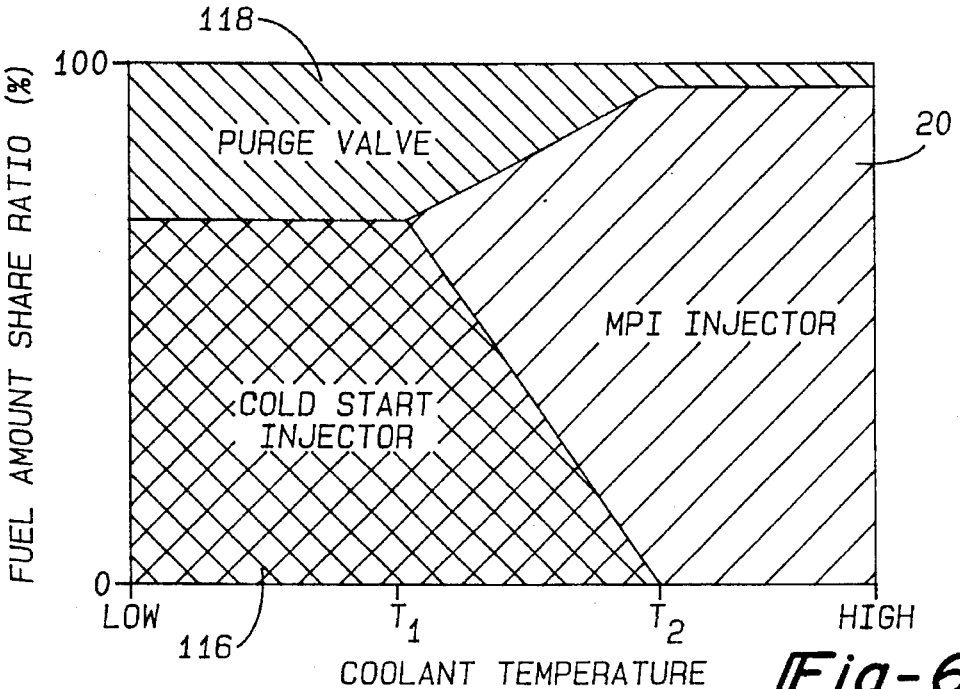
FIG. 6 is a graph illustrating a fuel amount share ratio versus engine coolant temperature of a preferred embodiment of the present invention.

With reference now to FIG. 6, a graph illustrating the amount of fuel provided from the cold start injector 40, fuel canister 42 and multipoint injectors 38 are thereshown as a function of coolant temperature and also assuming a low fuel demand or idle engine condition. As shown in FIG. 6, during a cold start engine condition, the amount of fuel provided by the cold start injector 40 is illustrated at block 116 while the amount of fuel provided from the canister 42 is illustrated at block 118. Typically, the cold start injector provides proportionally more fuel to the engine 10 than the canister 42. Additionally, since an idle condition is present, the multipoint injectors 38 are deactivated when the engine 10 is cold.

Between temperatures $T_1$, i.e. a semi-warm engine condition, and temperature $T_2$, i.e. a warm or normal engine operating condition, the amount of fuel provided by both the cold start injector 40 as well as the fuel canister 42 diminishes and, simultaneously, the amount of fuel provided by the multipoint injectors 38, illustrated at block 120, increases. After a warm or normal engine operating condition is reached, the cold start fuel injector 40 is deactivated and the canister 42 provides only minimal fuel to the engine 10 in accordance with its normal purging operation.

Figure 7:
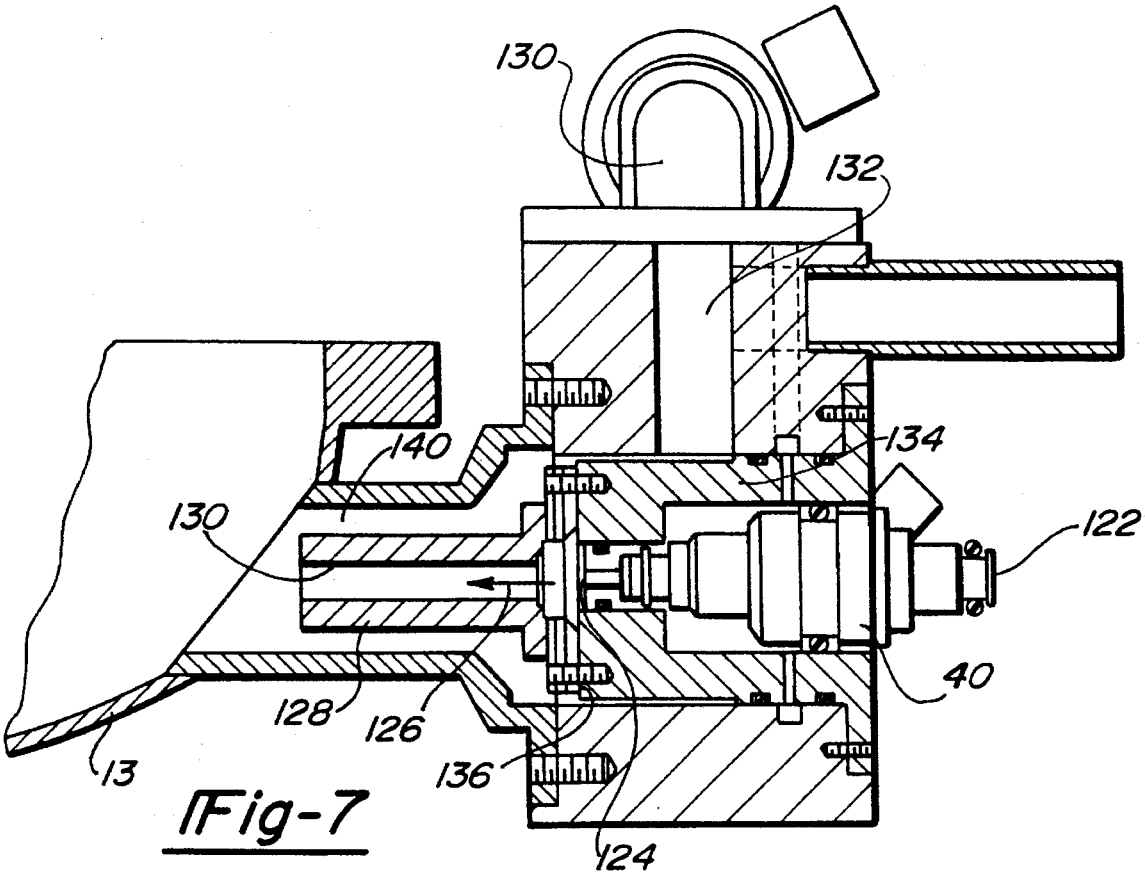
FIG. 7 is a partial-sectional view illustrating a preferred embodiment of a cold start fuel injector of the present invention.

With reference now to FIG. 7, a preferred embodiment of the cold start injector 40 is thereshown having an inlet 122 and outlet 124. The inlet 122 is fluidly connected with the outlet from the pump 36 so that, upon each activation of the cold start injector 40 by the ECU 26 (FIG. 1), the cold start fuel injector 40 generates a fuel injection pulse 126 from its outlet 124. This fuel injection pulse 126 enters the intake manifold 14 and is inducted into the engine combustion chambers 12. Furthermore, in the well-known fashion, the cold start fuel injector 40 is pulsed in synchronism with each intake cycle of each combustion chamber 12 so that a single cold start fuel injector 40 is provided for the entire internal combustion engine 10.

In order to enhance the vaporization or atomization of the fuel injected by the cold start injector 40, the present invention provides a number of different schemes. First, in FIG. 7, a tubular and cylindrical heater 128 is provided in alignment with the fuel injection pulse 126 from the cold start injector 40 so that the fuel injected by the cold start injector 40 passes through the interior 128 of the heater 128. Heater 130 is preferably a ceramic heater and enhances the vaporization of the fuel from the cold start injector 40.

Still referring to FIG. 7, the system preferably includes an idle speed control valve 130 which provides air flow to the engine during a closed throttle condition. The ECU 26 controls the idle speed control valve 130 to selectively open the idle speed control valve 130 whenever required.

Unlike the previously known idle speed control valves, the idle speed control valve 130 of the present invention diverts the air flowing through the idle speed control valve 130 through passageway 132 and to a chamber 134 surrounding the cold start fuel injector 40. A portion of the air flow into the chamber 134 enters the inlet end of the heater 128 via an annular opening 136 so that a portion of the air flow travels colinearly with the fuel injection pulse from the injector 40 thus enhancing vaporization of the fuel.

A portion of the air from the idle speed control valve 130 also flows around a chamber 140 and transversely mixes with the outlet from the interior 130 of the heater 128. In doing so, this transverse air flow also enhances the vaporization of the fuel in the desired fashion.

Figure 8:
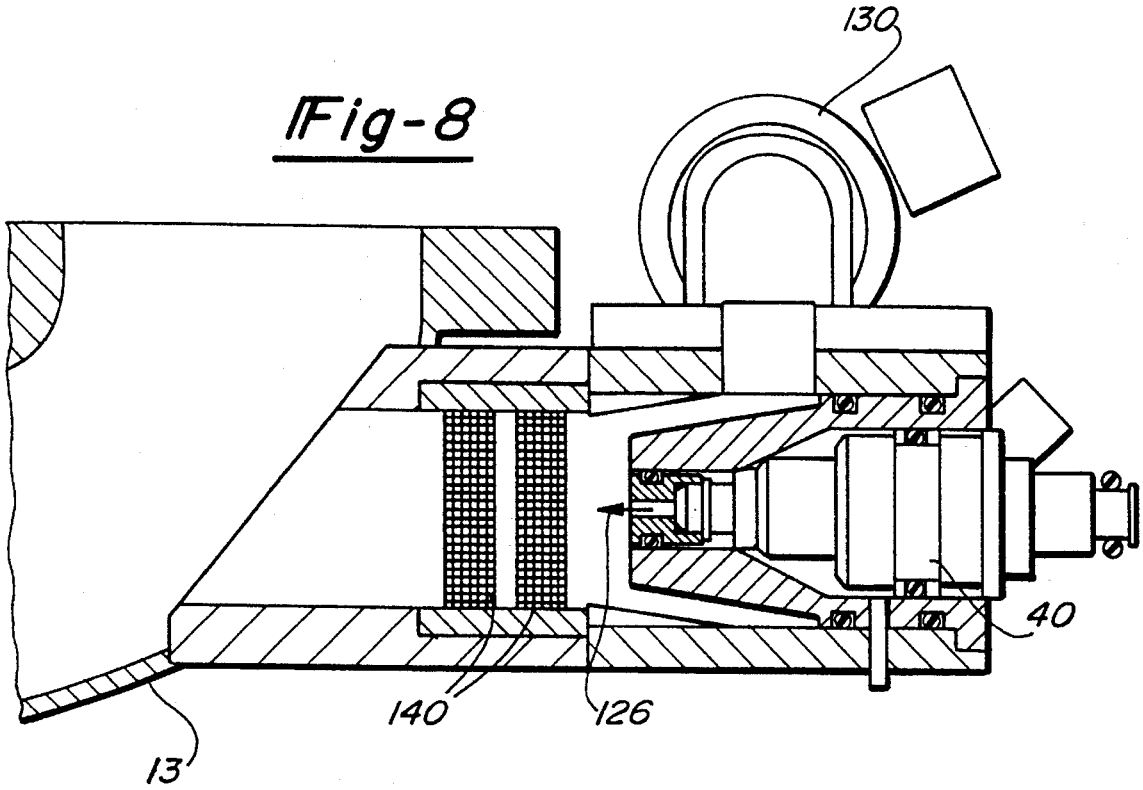
FIG. 8 is a cross-sectional view illustrating a second preferred embodiment of the cold start fuel injector of the present invention.

With reference now to FIG. 8, a further modification of the cold start fuel injector 40 is thereshown in which, as before, air flow from the idle speed control valve 130 intermixes with the fuel injection 126 from the cold start injector 40 in order to enhance the vaporization and intermixing of the air and fuel. Unlike the embodiments shown in FIG. 7, in FIG. 8, the intermixed air and fuel pass through a honeycomb heater 140, preferably having two stages, in order to further vaporize the fuel. The vaporized fuel then enters the intake manifold 13 as previously described.

With reference now to FIGS. 9*a*–9*d*, alternative embodiments for the heater 140 of FIG. 8 are thereshown. For example, in FIG. 9*a*, a conical heater 142 having its apex pointed toward the outlet from cold start fuel injector 40 is disposed in the gas flow passageway between the cold start injector 40 and the intake manifold 13. This conical heater 142 induces turbulence in the air which enhances fuel vaporization.

Figure 9A:
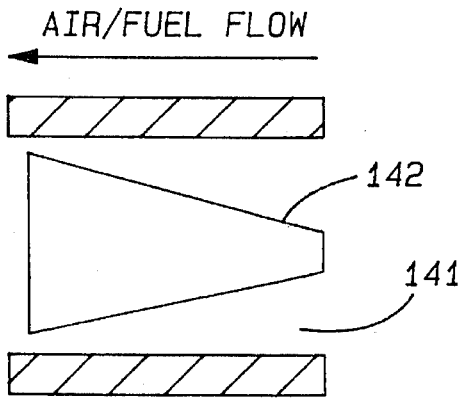
Figure 9B:
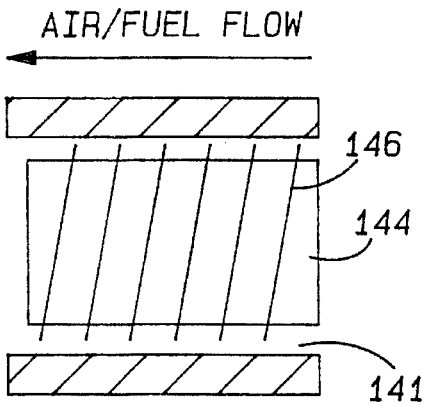

Similarly, in FIG. 9*b*, a cylindrical heater 144 is provided in the gas passageway 141 between the fuel injector 40 and the intake manifold 13. Additionally, an outwardly protruding helix 146 is also provided around the heater 144 to further add turbulence to the gas flow to the intake manifold 13 again enhancing vaporization of the fuel.

Figure 9C:
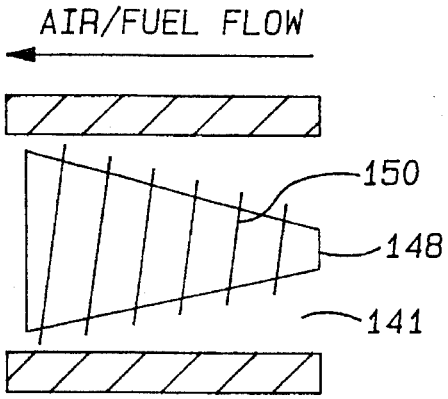

Similarly, in FIG. 9*c*, a conical heater 148 having its apex pointing towards the outlet from the cold start injector 40 is also provided in the gas passageway 141 to the intake manifold 13. This heater 148 also includes an outwardly protruding helix 150 which effectively swirls the gas flow through the passageway 141 between the cold start injector 40 and the intake manifold 13.

Figure 9D:
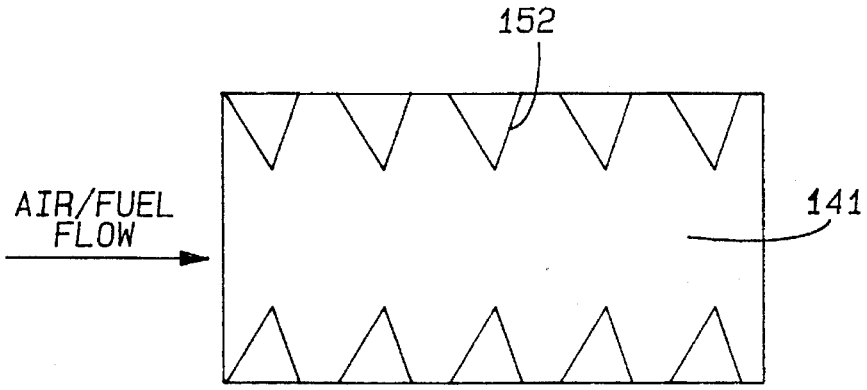

Lastly, in FIG. 9*d*, an inwardly protruding helix 152 is provided around the outer periphery of the passageway 141 between the cold start injector 40 and the intake manifold 13. This helix 152 also acts to swirl and create turbulence of the gas flow through the passageway 141 thereby enhancing vaporization of the fuel. Preferably, the helix 152 is heated.

Additionally, the heater 152 around the outer periphery of the passageway 141 may be used in conjunction with an interior heater such as that shown in FIGS. 9*a*–9*c* to further enhance vaporization of the fuel.

Figure 11A:
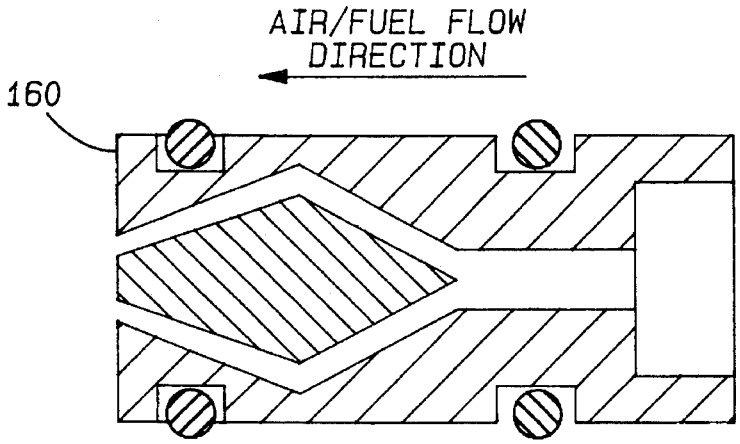

With reference now to FIGS. 10 and 11*a*, a still further modification of the cold start fuel injector 40 in which, as before, the cold start fuel injector 40 generates a fuel injection pulse 126 at its output which ultimately enters the passageway 141 and is inducted into the intake manifold 13 (not shown). Similarly, as before, the idle speed control valve 130, when open, provides air flow to the passageway 141 to further vaporize the fuel from the cold start injector 40.

Figure 11B:
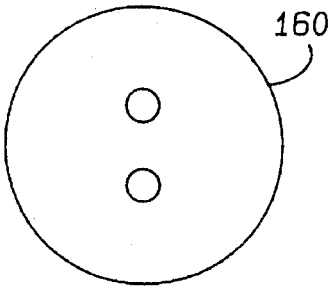

Unlike the FIGS. 7 and 8 embodiments, however, in FIGS. 10, 11*a* and 11*b* a fuel tip 160 is provided between the outlet from the cold start fuel injector 40 and the gas passageway 141. This injector tip 160, furthermore, includes at least two passageways 162 and 164 through which the fuel flows, preferably in equal amounts. Furthermore, the passageways 162 and 164 are angled through the injector tip 160 so that fuel flow outwardly from the passageways 162 and 164 intersect each other at 166. This intersection or collision of the fuel flow with each other increases the vaporization of the fuel in the passageway 141 together with the air flow from the idle speed control valve 130 to further enhance vaporization of the fuel.

Figure 11C:
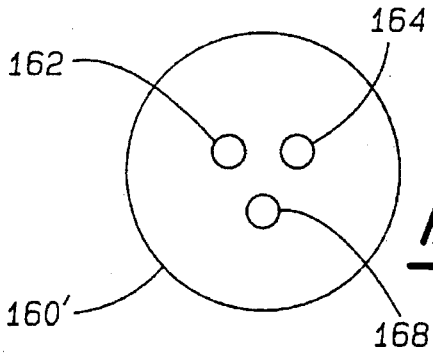

A modification of the fuel injector tip 160 is shown in FIG. 11*c* in which three passageways 162, 164 and 168 are provided through the injection tip 160'. Preferably, one-third of the fuel flow from the cold start injector 40 flows through each of the passageways 162, 164 and 168. Additionally, each of the passageways 162, 164 and 168 are angled so that the outlet flow from each of these passageways intersects each other at a single point downstream from the injector tip 160' for enhanced vaporization of the fuel.

Figure 11D:
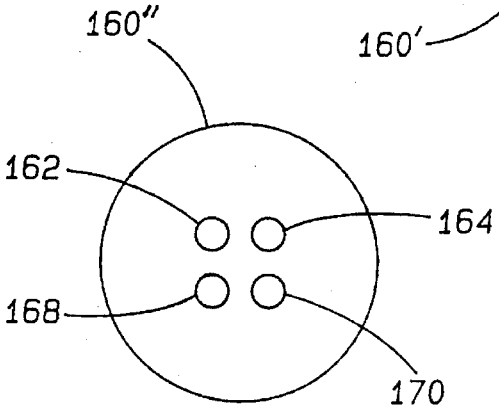

Similarly, FIG. 11*d* shows yet a further modification of the fuel injector tip 160". The fuel injector 160" includes four passageways 162, 164, 168 and 170 which are formed through the tip 160". Preferably, one-quarter of the fuel flow from the cold start injector flows through each passageway 162, 164, 168 and 170 and the outlets from the passageways 162, 164, 168 and 170 are angled so that they intersect each other at a position slightly downstream from the end of the tip 160".

With reference now to FIGS. 12–14, a still further modification of the cold star fuel injector 40 is thereshown in which, as before, the cold star fuel injector 40 generates a fuel injection pulse at its output 126 which ultimately enters the passageway 141 and is inducted into the intake manifold 13 (not shown). As before, the idle speed control valve 130, when opened, provides air flow to the passageway 141 to further vaporize the fuel from the cold start injector 40.

Unlike the previously described cold start fuel injectors 40, the cold start fuel injector 40 illustrated in FIG. 12 includes a swirl ring 180 having a central through bore 182 (FIG. 13). The ring 180 is mounted within a housing 184 supporting the cold start fuel injector 40 so that the opening 182 is coaxial with the fuel injection pulse 126 from the cold start injector 40.

As best shown in FIGS. 13 and 14, the ring 182 includes a plurality of openings 186 which extend between the outer periphery 188 of the ring 180 and the opening 182. The longitudinal axis of each opening 186, however, is offset from the center of the ring 180 so that air flow through the openings 186 and into the opening 182 enters the opening 182 tangentially. In doing so, air flows through the passageways 186 and into the opening 182 to create a swirling action as indicated by arrow 190 (see FIG. 13). This swirling action of air flow through the passageways 186 and into the opening 182 thus enhances atomization of the fuel pulse 126 from the cold start fuel injector 40.

With reference now particularly to FIG. 12, the air flow provided to the ring 180 from the idle speed control valve 130 passes first through a passageway 192 in the housing 184. From the passageway 192, the air flows through a clearance passageway 194 through the outer periphery 188 of the ring 180 and thus through the outer periphery of the passages 186. Additionally, air flow is also provided through a metered passageway 196 to a chamber 198 in the housing 184 around the cold start fuel injector 40. This air flow flows around the tip 200 of the cold start fuel injector 40 and intermixes with the fuel injection pulse 126 from the cold start fuel injector 40 to also enhance the intermixing of the fuel with the air. The air/fuel spray from the cold start injector 40 also passes through three spaced honeycomb heaters 202 which vaporize the fuel prior to its entry into the intake manifold.

From the foregoing, it can be seen that the present invention provides a cold start fuel control system for an internal combustion engine which reduces emissions by achieving a stoichiometric or slightly lean air/fuel mixture and yet ensures starting of the invention during a cold engine condition. The present invention achieves this not only by utilizing the fuel vapors from the fuel vapor canister, but also ensuring that maximum vaporization of the fuel from the cold start injector is achieved. Such maximum vaporization of the fuel from the cold start injector is achieved not only through the use of heaters but also by directing the idle speed air through the cold start fuel injector in order to further vaporize or atomize the fuel within the air.

Having described my invention, however, many modifications thereto will become apparent to those skilled in the art to which it pertains without deviation from the spirit of the invention as defined by the scope of the appended claims.

We claim:

1. A cold start fuel control system for an internal combustion engine of the type having at least one combustion chamber, an intake manifold fluidly connected with the combustion chamber and a source of fuel, said fuel control system comprising:

a fuel vapor canister having an interior chamber fluidly connected to the source of fuel and a normally closed purge valve fluidly connected between the canister and the intake manifold, means for measuring an operating temperature of the engine and for providing a temperature output signal representative, a cold start fuel injector having an inlet and an outlet, means for fluidly connecting said injector inlet to the fuel source and for fluidly connecting said injector outlet to the intake manifold, means responsive to said temperature output signal whenever said temperature output signal is less than a predetermined amount for selectively activating said fuel injector so that said fuel injector injects fuel at its outlet, means responsive to said temperature output signal whenever said temperature output signal is less than said predetermined amount for selectively opening the purge valve.

2. The invention as defined in claim 1 wherein said cold start fuel injector outlet is open to said interior chamber of said canister.

3. The invention as defined in claim 1 and comprising means for heating said interior chamber of said canister.

4. The invention as defined in claim 2 and comprising means for heating said interior chamber of said canister.

5. The invention as defined in claim 1 and comprising means for measuring mass gas flow from said canister to the intake manifold and for providing a canister mass gas flow signal representative thereof, means for calculating a target air/fuel ratio for said engine, means responsive to said canister mass gas flow signal for selectively activating said cold start fuel injector in a duty cycle sufficient to attain said target air/fuel ratio.

6. The invention as defined in claim 1 and comprising means for vaporizing fuel from said cold start fuel injector outlet.

7. The invention as defined in claim 6 wherein said vaporizing means comprises a heater.

8. The invention as defined in claim 7 wherein said heater comprises a cylindrical tube through which fuel is injected.

9. The invention as defined in claim 7 wherein said heater comprises a honeycomb heater through which fuel is injected.

10. The invention as defined in claim 6 wherein said vaporizing means comprises means for directing an airflow through said cold start injector so that said airflow intermixes with fuel injected from said cold start injector outlet.

11. The invention as defined in claim 10 wherein at least a portion of said airflow is directed colinearly with said injected fuel.

12. The invention as defined in claim 10 wherein at least a portion of said airflow is directed traversely of said injected fuel.

13. The invention as defined in claim 10 wherein said vaporizing means comprises means for increasing intermixing of said injected fuel with said airflow.

14. The invention as defined in claim 13 wherein said intermixing means comprises means for swirling said airflow and said injected fuel together.

15. The invention as defined in claim 14 wherein said swirling means comprises an elongated member axially aligned with said injected fuel, said elongated member having; an outwardly extending helical protrusion.

16. The invention as defined in claim 14 wherein said elongated member is conical in shape having its apex directed against the direction of said injected fuel.

17. The invention as defined in claim 14 and comprising means for heating said elongated member.

18. The invention as defined in claim 5 wherein the internal combustion engine includes a multipoint fuel injector associated with each combustion chamber and wherein said system further comprises means responsive to said temperature output signal representative of increasing operating temperature for proportionately activating said multipoint injectors and simultaneously proportionately deactivating said cold start injector.

19. The invention as defined in claim 1 wherein the engine includes a rotary output shaft and wherein said means for activating said purge valve includes means for activating said purge valve in synchronism with rotation of the rotary output shaft.

20. The invention as defined in claim 19 and comprising means for measuring mass gas flow from said canister to the intake manifold and for providing a canister mass gas flow signal representative thereof, means for calculating a target air/fuel ratio for said engine, means responsive to said canister mass gas flow signal for selectively activating said purge vane in a duty cycle sufficient to attain said target air/fuel ratio.

21. A cold start fuel control system for use with an internal combustion engine of the, type having at least one combustion chamber, an intake air passage means fluidly connected with the combustion chamber and a source of fuel, said fuel control system comprising:

a cold start fuel injector having an inlet fluidly connected to said fuel source and an outlet open to said air passage means, air valve means having an air inlet fluidly connected to said intake air passage means and an air outlet fluidly connected to said cold start fuel injector, said air valve means being movable between an open position and a closed position, wherein in said open position air flows through said cold start fuel injector and enhances atomization of fuel, means for measuring an operating temperature of the engine and for providing a temperature output signal representative, means responsive to said temperature output signal whenever said temperature output signal is less than a predetermined amount for selectively activating said cold start fuel injector and simultaneously activating said air valve means to an open position so that an air and fuel mixture enters said air intake passage means, and means for enhancing intermixing of said fuel with said air in said air and fuel mixture.

22. The invention as defined in claim 21 wherein said intermixing means comprises a tubular and cylindrical heater through which said air and fuel mixture passes.

23. The invention as defined in claim 22 wherein said heater comprises a honeycomb heater through which fuel is injected.

24. The invention as defined in claim 21 wherein said intermixing means comprises means for directing an airflow through said cold start injector so that said airflow intermixes with fuel injected from said cold start injector outlet.

25. The invention as defined in claim 24 wherein at least a portion of said airflow is directed colinearly with said injected fuel.

26. The invention as defined in claim 24 wherein at least a portion of said airflow is directed traversely of said injected fuel.

27. The invention as defined in claim 21 wherein said intermixing means comprises means for swirling said airflow and said injected fuel together.

28. The invention as defined in claim 27 wherein said swirling means comprises an elongated member axially aligned with said injected fuel, said elongated member having an outwardly extending helical protrusion.

29. The invention as defined in claim 27 wherein said elongated member is conical in shape having its apex directed against the direction of said injected fuel.

30. The invention as defined in claim 27 and comprising means for heating said elongated member.

31. The invention as defined in claim 27 wherein said swirling means comprises a ring having a central through bore aligned with said outlet from said cold start fuel injector, means for supplying air to an outer periphery of said ring, and a plurality of circumferentially spaced air passageways extending between said outer periphery and said central through bore of said ring.

32. The invention as defined in claim 31 wherein said ring passageways each have an axis which intersects said central through bore substantially tangentially.

* * * * *

UNITED STATES PATENT AND TRADEMARK OFFICE

CERTIFICATE OF CORRECTION

PATENT NO. : 5,482,023
DATED : January 9, 1996
INVENTOR(S) : Frank W. Hunt et al.

It is certified that error appears in the above-indentified patent and that said Letters Patent is hereby corrected as shown below:

Column 3, line 26, delete "fight" and insert --right--.

Column 4, line 12, delete "50";

Column 4, line 14, after "valve", insert --50--;

Column 4, line 36, delete "retake", insert --intake--;

Column 4, line 60, delete "star" and insert --start--.

Column 9, line 11, delete "star", and insert --start--;

Column 9, line 12, delete "star", and insert --start--.

Column 11, line 36, delete "vave" and insert --valve--.

Signed and Sealed this

Eleventh Day of June, 1996

Bruce Lehman

*Attest:*

BRUCE LEHMAN

*Attesting Officer*

*Commissioner of Patents and Trademarks*